United States Patent [19]

Bueb et al.

[11] 4,034,548

[45] July 12, 1977

[54] PROCESS FOR THE PRODUCTION OF STRETCH-TEXTURED YARNS WITH IMPROVED PROPERTIES

[75] Inventors: Michael Bueb, Opladen; Wolfgang Rellensmann, Zons; Lothar Ruuprecht, Dormagen, all of Germany

[73] Assignee: Bayer Aktiengesellschaft, Leverkusen, Germany

[21] Appl. No.: 575,704

[22] Filed: May 8, 1975

[30] Foreign Application Priority Data

May 10, 1974 Germany ..... 2422690

[51] Int. Cl.[2] ..... D02G 1/02

[52] U.S. Cl. ..... 57/157 TS; 57/77.4

[58] Field of Search ..... 57/77.4, 157 TS

[56] References Cited

U.S. PATENT DOCUMENTS

| | | | |
|---|---|---|---|
| 3,756,006 | 9/1973 | Heinroth et al. | 57/77.4 |
| 3,846,966 | 11/1974 | Peacock et al. | 57/157 TS X |
| 3,879,927 | 4/1975 | Bueb et al. | 57/77.4 |
| 3,948,034 | 4/1976 | Gorden | 57/157 TS |

*Primary Examiner*—Richard C. Queisser
*Assistant Examiner*—Charles Gorenstein
*Attorney, Agent, or Firm*—Plumley and Tyner

[57] ABSTRACT

The present invention relates to a process for the simultaneous stretch-texturing of synthetic, at least partly thermoplastic filaments or yarns using false twisters, more especially friction false twisters wherein the ratio $S_2/S_1$ between the tractive or tensile forces $S_1$, acting on the filament before the false twister, and $S_2$, acting on the filament after the false twister, is adjusted to from 1.0 to 1.4 by adapting the ratio between the rotational speed of the false twister and the rate of travel of the filament or yarn, and the denier-related twisting of the yarn is from 5 to 50% higher than the level of twisting which is normally applied in conventional false-twist texturing processes using a spindle and which can be calculated on the basis of the Heberlein formula. Moreover, the invention relates to a yarn produced by the afore-described process.

1 Claim, 7 Drawing Figures

PROCESS FOR THE PRODUCTION OF STRETCH-TEXTURED YARNS WITH IMPROVED PROPERTIES

Figure 1:
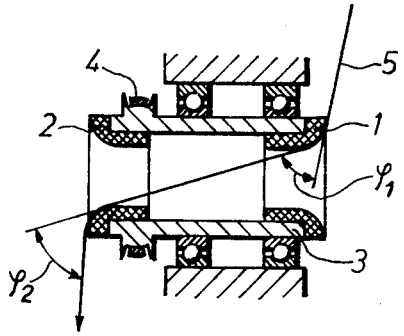

This invention relates to a process for the production of stretch-textured, textile filaments or yarns which have certain, improved quality features and which undergo relatively little shrinkage during further processing into sheet-form textiles, i.e. during the transition from the unfinished to the finished article.

In the so-called torsional texturing of yarns or filaments consisting at least partly of thermoplastic, synthetic material, the yarns of filaments have to travel through a heating and a cooling zone in twisted form. The twist is normally imparted by a false twister which transmits a torque to the filament.

In so-called simultaneous stretch-texturing, the yarn is continuously stretched and textured in a signle operation. To this end, the unstretched or only partly stretched yarn is guided over delivery rollers and guided first through a heating zone and then through a subsequent cooling zone. The yarn then travels through a twister. After leaving the twister, the yarn is guided over a stretching godet to the further processing stages consisting, for example, of a second heat treatment, a re-oiling stage and a take-up or winding stage.

The quality characteristics of the textured yarn are determined by the properties of the starting material, and particularly by the type of polymer. At the same time, however, they are determined to a significant extent by the principle behind the process, by the way in which the process is carried out and by the adjustment of the process parameters.

It is desirable to produce a yarn with certain quality characteristics, for example, high tensile strength, high crimp stability and favourable crimp geometry. Another important factor is that the so-called boiling-induced shrinkage of the yarn should be low enough to minimise possible changes in the yarn after texturing under the effect of heat.

In the production of sheet-form textiles, it is desirable that, after production, the sheet-form textiles should not undergo any reduction in size through shrinkage, nor lose any of their original width and dimensional stability. In the manufacture of hosiery on automatic knitting machines, the hose is said to undergo "shrinkage" during the transition from the unfinished to the finished article. Accordingly, the hose has to be "finished", for example in order to develop the full crimp or for dyeing.

Simultaneous stretch-texturing processes are already known, cf. for example German offenlegungsschriften Nos. 1,946,791 2,049,413 or 2,049,357 . Modern texturing processes are carried out with so-called friction twisters which enable texturing to be carried out at high speeds, for example at speeds of from 300 to 1000 meters per minute. Numerous types of friction twisters of this kind are described in the Patent literature.

British patent specification No. 797,051 for example relates to an arrangement in which the filament is drawn through a twist tube, whose inner surfaces, with which the filament is in frictional contact, consist of a material with a high coefficient of friction.

In other known false-twist systems, the yarn is guided through two twist tubes. German Offenlegungsschrift No. 2,305,871 for example relates to such an arrangement in which the friction elements consist of a hard, inelastic smooth material. German Offenlegungsschrift No. 2,252,923 relates to an arrangement in which the yarn comes successively into contact with two moving, twist-imparting surfaces which are deformable and differ from one another in hardness.

Experience has shown that, in order to obtain a satisfactorily textured yarn, the rotational speed of the twist tubes in most of these internal friction twisters is adjusted in such a way that the ratio $S_2/S_1$ between the tractive or tensile forces pulling the filament ($S_1$ before the twister and $S_2$ after the twister) is preferably between 2 and 4.

U.S. Pat. No. 3,879,927 relates to a false twist system, consisting of two or more internal friction twisters arranged consecutively, in which the friction surfaces at the inlet end have a high friction coefficient whilst the friction surfaces at the outlet ends have as low a coefficient of friction as possible. It is readily possible to obtain low tractive force ratios $S_2/S_1$ with this false twist arrangement.

It is known that most stretch-textured yarns, especially those of polyamide-6, have a relatively high boiling-induced shrinkage of about 8 to 15%.

It is also known, in the case of hosiery yarns, that most stretch-textured polyamide yarns lead to fairly serious shrinkage of the hose during the transition from unfinished to finished articles, and that wide hose can only be produced with difficulty. In the manufacture of hosiery on conventional automatic knitting machines, this deficiency can be eliminated by setting the machines accordingly, for example in regard to stitch size.

Accordingly, conventional stretch-textured yarns can readily be processed on conventional automatic knitting machines. However, the further development of automatic knitting machines has recently seen the emergency of a machine which enables hose to be produced in a single operation, i.e. in one piece. These new machines are known as one-piece machines. The only yarns which can be used in these machines for the insert in the upper part of the hose are yarns with improved quality characteristics. Thus, these yarns should only cause limited shrinkage in the hose during the finishing process.

It is known these properties are exhibited by yarns of the type produced by the conventional fales-twist texturing process using a spindle (diabolo), and more especially by yarns of the type which are textured from already stretched yarn. Yarns of this kind normally have a low boiling-induced shrinkage of from 2 to 7%.

So far as the connection between boiling-induced shrinkage in the yarn and shrinkage of the sheet-form textile material is concerned, it may be assumed from the prior art that very low boiling-induced shrinkage of the yarn is essential to minimal shrinkage of the sheet-form textile material.

Yarns produced by the known process of simultaneous stretch-texturing do not have the requisite quality characteristics, so that they are not suitable for use as upper-leg yarns for one-piece machines. On the other hand, however, it would be desirable to produce the special one-piece yarns by simultaneous stretchtexturing because this process can be more favourable in terms of costs than the conventional false-twist process.

Accordingly, the object of the invention is to produce simultaneously stretch-textured yarns with the required quality characteristics, so that they may be used for example in automatic one-piece knitting machines and only cause limited shrinkage of the sheetform material during the transition from the unfinished to the finished articles.

It has now surprisingly been found that it is possible to produce a yarn with the requisite quality characteristics by simultaneous stretch-texturing, providing a twister of the type described, for example, in U.S. Pat. No. 3,879,927 is used for twisting.

The object which the invention seeks to achieve cannot be resolved with any known twister, but only with a few special twisters, for example the twisters described in the aforementioned U.S. Pat. No. 3,879,927, or twisters of the kind with which the process parameters specified further below can be adjusted or realised.

Accordingly, the present invention relates to a process for the simultaneous stretch-texturing of synthetic, at least partly thermoplastic filaments or yarns using false twisters, more especially friction false twisters which is distinguished by the fact that the ratio $S_2/S_1$ between the tractive forces $S_1$, acting on the filament before the false twister, and $S_2$, acting on the filament after the false twister, is adjusted to form 1.0 to 1.4 by adapting the ratio between the rotational speed of the false twister and the rate of travel of the filament or yarn, and the denier-related twisting of the yarn is from 5 to 50% higher than the level of twisting which is normally applied in conventional false-twist texturing processes using a spindle and which can be calculated on the basis of the Heberlein formula. U.S. Pat. No. 3,879,927 relates to a process for the simultaneous stretch-texturing of synthetic filaments or yarns using internal friction twisters, which is characterised by the fact that, after passing through a heating zone and a cooling zone, the filament or the yarn is guided, and at the same time stretched, through two or more internal friction twisters and a high torque is imparted to the filament or yarn by the friction surfaces at the inlet ends of the twist tubes in relation to the increasingly weaker torque which is applied at the outlet ends of the twist tubes.

The arrangement for carrying out the process described in U.S. Pat. No. 3,879,927 and hence also one possible arrangement for carrying out the process according to the invention, consists of two or more internal friction twisters arranged consecutively, the friction surfaces at the inlet end of the internal friction twisters having a high friction coefficient, whilst the friction surfaces at the outlet ends of the internal friction twisters have a low friction coefficient in relation to the friction surfaces at the inlet ends.

The coefficient of friction of the friction surfaces at the inlet ends should preferably be in the range from 0.40 to 0.7, depending upon the material to be textured. Coefficients of friction at the inlet ends of from 0.5 to 0.6 have proved to be particularly favourable. The friction coefficient at the outlet ends of the internal friction twisters should be as low as possible, preferably less than 0.3.

The arrangement according to U.S. Pat. No. 3,879,927 which is used for carrying out the process according to the present invention is described in more detail in the following with reference to the accompanying drawings, wherein:

FIG. 1 shows a conventional internal friction twist tube with two identical orifices.

Figure 2:
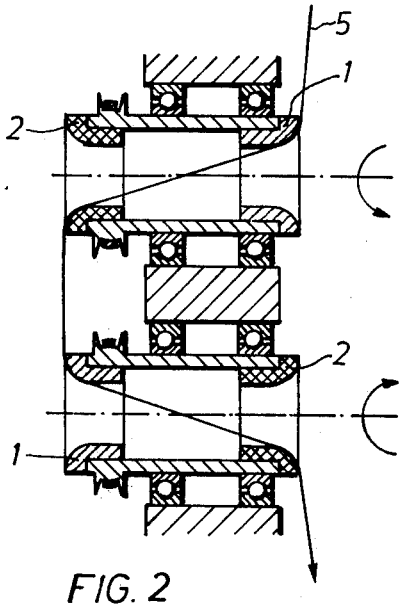

FIG. 2 shows a false twister according to U.S. Pat. No. 3,879,927.

Figure 2A:
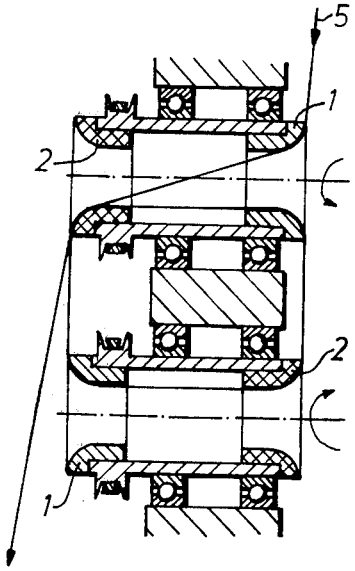

FIG. 2*a* shows a variant of the false twister according to U.S. Pat. No. 3,879,927.

Figure 3:
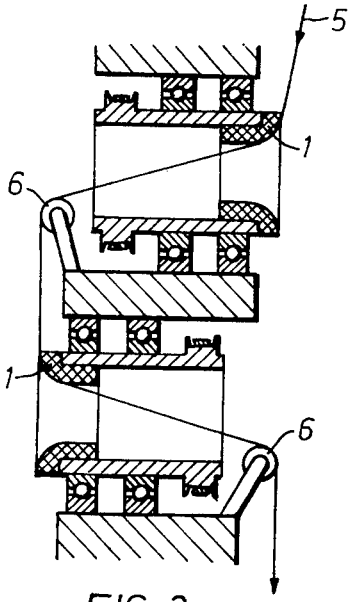

FIG. 3 shows a variant of the false twister according to U.S. Pat. No. 3,879,927.

Figure 4:
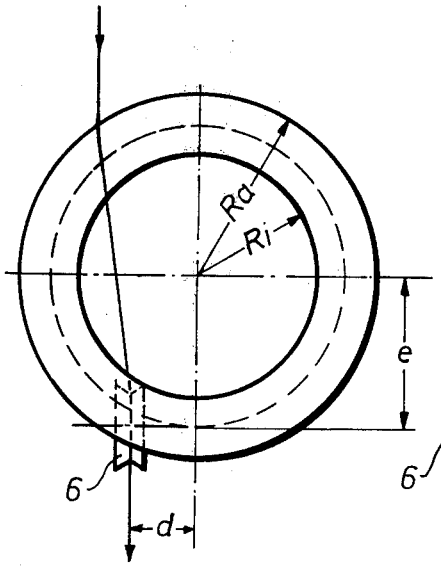

FIG. 4 shows the path followed by the filament through a modified twist tube with an offset outlet roller.

Figure 5:
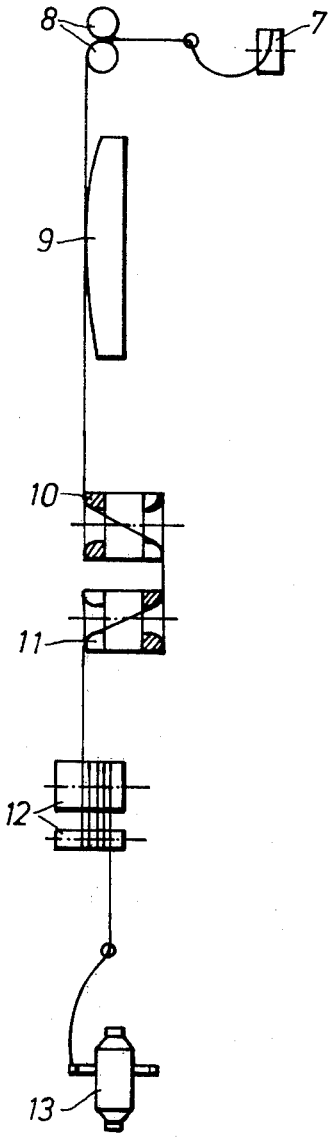

FIG. 5 illustrates a texturing process using the false twist arrangement (simultaneous stretch texturing) according to U.S. Pat. No. 3,879,927.

In one simple internal friction twist tube (cf. FIG. 1), a twist tube 3, driven for example by a drive belt 4, comprises an inlet orifice 1 and an outlet orifice 2. The filament 5 is drawn through the twist tube in the manner illustrated in FIG. 1. The filament has a torque imparted to it under the effect of its friction contact with the rotating orifices 1 and 2. The looping angles $\gamma 1$ and $\gamma 2$ at the inlet and outlet end, respectively, are each between 45° and 90° for example, according to requirements. It has been found that the ratio of the tractive force in the filament after it has left the twist tube to the tractive force applied to the filament before it enters the twist tube is considerably reduced when the outlet orifice 2 has a lower coefficient of friction than the inlet orifice 1. Unfortunately, the torque applied to the filament by the twist tube also decreases with an orifice combination of this kind. However, if after leaving the twist tube the filament is guided through a second twist tube similarly provided with different orifices, it is surprisingly found that, on the one hand, the ratio between the tractive forces before and after this double twister is still low whilst, on the other hand, a sufficiently high torque is applied.

In one embodiment of a twister, as illustrated in FIG. 2, the filament 5 initially travels through an inlet orifice 1 with a high friction coefficient and then through an outlet orifice 2 with as low a friction coefficient as possible (for example of polished steel or ceramic). In the embodiment illustrated in FIG. 2, comprising two twist tubes arranged consecutively, the filament subsequently travels through a high-friction inlet orifice 1 again and then through an outlet orifice 2 having as low a fricition coefficient as possible. The outlet orifices 2 may be interpreted as being substantially friction-free guides by which the twisted filament is guided from the preceding into the following twist tube.

Finally, the process according to U.S. Pat. No. 3,879,927 also includes filament guides where the filament is guided twice through the same twist tube. In an arrangement of, for example, two twist tubes according to FIG. 2*a*, the filament initially travels through the first twist tube, then through the second twist tube and finally back again through the first twist tube.

Figure 4A:
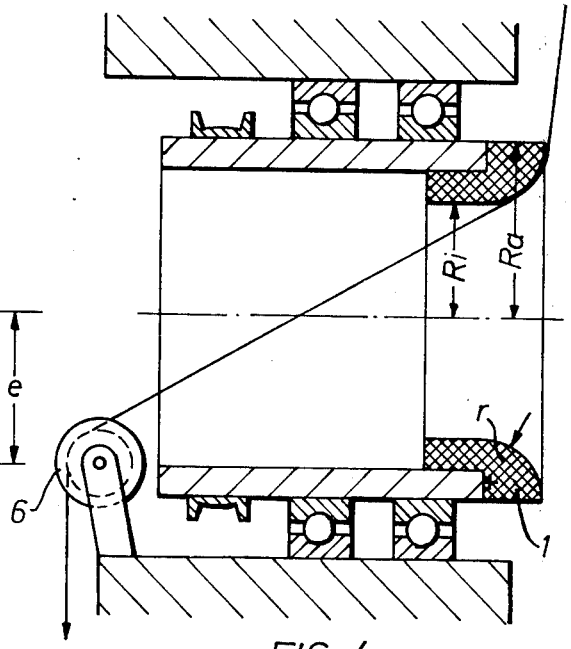

Instead of guiding the filament through a smooth outlet orifice, it is also possible, as shown in FIGS. 3, 4 and 4*a* for the filament to be guided through a filament guide, but preferably over a small roller 6, as it leaves the twist tube in order to avoid contact between the filament and the twist tube at its outlet end. In order to enhance the effect of the inlet orifice in promoting travel of the filament, provision is made in a preferred embodiment, illustrated in FIGS. 4 and 4*a* for the guide roller 6 to be arranged in such a way that the filament only undergoes a very slight change in its direction of travel, as seen in the vertical projection onto the inlet orifice (FIG. 4). The distance *d* amounts to about (0.2 to 0.8) $R_i$. The distance *e* is chosen so that the filament is guided closely over the outlet edge of the twist tube without actually touching it.

In order to enhance the effect of a twister of this kind, active at its inlet end only, in promoting filament travel, provision is made in another embodiment of the process according to the invention for the orifices to be enlarged to such an extent that an optimum relationship exists between torque generation, tractive-force ratio and the uniformity with which friction is transmitted.

In a conventional orifice, the characteristic radii are, for example, as follows: $R_i = 10 - 15$ mm and $R_a = 20 - 30$ mm. By contrast, in an enlarged orifice, the characteristic radii are for example as follows: $R_i = 20 - 30$ mm and $R_a = 40 - 60$ mm. The radius of curvature $r$ amounts for example to between 5 and 10 mm. The meaning of the radii $R_i$, $R_a$ and $r$ is apparent from FIGS. 4 and 4*a*. The advantage of enlarging the geometry of the orifices is that the surface speeds are increased by the enlargement factor. In addition, it has surprisingly been found in practice that, in enlarged orifices, the effect of the inlet orifice in promoting filament travel is enhanced.

According to FIG. 5, a filament travels from a spinning bobbin 7 over delivery rollers 8 and a heating element 9. The filament then travels through two internal friction twisters 10 and 11 arranged consecutively, and is continuously stretched over the stretching godet 12 and, optionally after passing through a second heating zone and following the application of a preparation, is wound onto the takeup bobbin 13.

The method and arrangment disclosed in U.S. Pat. Nos. 3,879,927 are suitable for texturing yarns consisting at least partly of thermoplastic material in accordance with the invention providing certain process perameters are maintained. These parameters are as follows:

a. The ratio between the rotational speed of the twister and the rate of travel of the filament has to be adjusted so that the ratio between the tractive forces acting on the filament $S_2/S_1$ at the twisting stage is very low i.e. of the order of 1.0 to 1.4, $S_1$ being the tractive force acting on the filament before the twister and $S_2$ the tractive force acting on the filament after the twister.

b. The yarn has to be adequately twisted in the texturing zone. It is known that the necessary twisting of a yarn is governed by the particular thickness of that yarn (denier). For conventional texturing with a false-twisting spindle, the socalled Herberlein formula is known from the literature:

$$D = 306\,000/67 + T\ [m^{-1}]$$

where:

is the twisting of the yarn, expressed by the number of whole twists in the yarn per unit length of the untwisted yarn, (dimension $[m^{-1}]$), is the denier of the yarn expressed in the dimension [dtex]. In the present case of stretch-texturing using a twister of the type described in U.S. Pat. No. 3,879,927 the twist obtained is some 5 to 50% greater, according to denier, than the twist which would have to be adjusted in false-twist texturing under the Heberlein formula. This greater twist is necessary for obtaining the required texturing result.

c. The yarn has to be stretched to a fairly considerable extent during texturing. A measure of the extent of stretching is the elongation at break of the textured yarn. Stretching has to be adjusted in such a way that the elongation at break of the textured yarn is between 20 and 38%.

The other process parameters, for example the temperatures and the residence times of the yarn in the texturing zone, are adjusted in accordance with the usual rules of texturing in such a way that the textile data of the yarn correspond to the usual values (cf. German Offenlegungsschrift Nos. 2,049,413 and 2,049,357).

In the case of yarns produced in the manner described, it has surprisingly been found, in the case of polyamide-6, that although boiling-induced shrinkage fell only slightly from 8 – 14% to 5 – 8%, the shrinkage which sheet-form materials produced from those yarns undergoes is nevertheless comprably low with the shrinkage caused by yarns produced by conventional false-twist texturing using a spindle, especially yarns of polyamide-6,6.

If necessary, these yarns may be processed into non-torque yarns by doubling two yarns textured with opposite twist.

The invention also relates to a simultaneously stretch-textured yarn consisting at least partly of thermoplastic material, which is characterised by the fact that it has a boiling-induced shrinkage of at most 8% and that, after processing into a sheet-form textile, it causes in that sheet-form textile material, during the transition from the unfinished to the finished article, a degree of shrinkage which, in comparative terms, is as low as the shrinkage which would occur in the sheet-form textile material had it been produced from yarns made from stretched material by the conventional false-twist process using a spindle.

The advantage afforded by the invention is that yarns with the aforementioned, required quality characteristics necessary for the use of modern knitting machines, especially one-piece machines, can be produced by stretch-texturing process using friction false twisters, so that the texturing speeds can be relatively high by comparison with conventional false-twist texturing using a spindle.

Accordingly, the invention also relates to sheet-form textiles, to hosiery and especially to one-piece hosiery made of the yarns accordingly to the invention for the production of sheet-form textile materials, more especially hosiery and one-piece hosiery.

The following Examples are to further illustrate the invention without limiting it.

EXAMPLE 1.

A polyamide-6 yarn (dtex 55 *f* 12) was textured by the simultaneous stretch-texturing process. To this end, the unstretched yarn was guided over delivery rollers, over a heating bar, cooled in a cooling zone and then led into a twister. The twister was in the form of a double twister in which the inlet orifices are made of Vulkollan (Registered Trade Mark of Bayer AG; Vulkollan is an elastomeric material, cf. "Bayer-Kunststoffe", Second Edition (1959), pages 80 to 88), whilst the outlet orifices were made of steel. After the twister, the yarn travelled over a stretching godet. A stretching ratio of 3.3:1 was adjusted between the delivery roller and the stretching godet. The texturing speed amounted to 500 meters per minute. The rotational speed of the twister was adjusted to 16,000 rpm. The ratio between the tractive forces $S_2/S_1$ acting on the filament at the twister was 1.1.

The textured yarn had an elongation at break of 35% and a boiling-induced shrinkage of 8%. The shrinkage of an upper stocking leg produced from the yarn amounted to 6%.

EXMAPLE 2.

A polyamide-6 yarn (dtex 44 *f* 10) was textured by simultaneous stretch-texturing. To this end, the unstretched yarn was guided over delivery rollers, passed over a heating bar, cooled in a cooling zone and then led into a twister. The twister was in the form of a double twister, in which the inlet orifices were made of Vulkollan (Registered Trade Mark of Bayer AG; Vulkollan is an elastomeric material, cf. "Bayer-Kunststoffe", Second Edition (1959), pages 80 to 88) whilst the outlet orifices were steel. After the twister, the yarn travelled over a stretching godet. A stretching ratio of 3.1:1 was adjusted between the delivery roller and the stretching godet. The texturing speed amount to 700 meters per minute. The rotational speed of the twister was adjusted to 17,000 rpm. The ratio between the tractive forces $S_2/S_1$ acting on the filament at the twister was 1.0. The textured yarn had an elongation at break of 36% and a boiling-induce shrinkage of 7%. The shrinkage of an upper stocking leg produced from the yarn amounted to 7%.

We claim:

1. In a process employing friction false twisters for the simultaneous stretch-texturing of synthetic filaments or yarns which are at least partly thermoplastic the improvement with comprises:

1. the ratio of the rotational speed of the false twister to the rate of travel of the filament or yarn so that the ratio $S_2/S_1$ of the tractive force on the filament or yarn after the false twister ($S_2$) to the tractive force on the filament or yarn before the false twister ($S_1$) is 1.0 to 1.4; and
2. maintaining the twisting in the filament or yarn at a value 5–50% in excess of that calculated from the Herberlein formula:

$$D = 306000/67 + T$$

wherein

D = the number of whole twists in the filament or yarn per meter of untwisted filament or yarn, and T = the denier of the filament or yarn expressed as dtex (grams per 10,000 meter).

* * * * *